United States Patent [19]

Sinka et al.

[11] 4,362,606

[45] Dec. 7, 1982

[54] PROCESS FOR SIMULTANEOUS RECOVERY OF VANADIUM, MOLYBDENUM AND GALLIUM FROM ALUMINA FACTORY ALUMINATE LIQUORS

[75] Inventors: Gabor Sinka; Mihaly Miskei, both of Budapest; Ferenc Toth; Laszlo Revesz, both of Almásfüzitó; Miklos Schlegel, Tata, all of Hungary

[73] Assignee: Magyar Aluminiumipari Troszt, Budapest, Hungary

[21] Appl. No.: 204,536

[22] Filed: Nov. 6, 1980

[51] Int. Cl.[3] ..... C25F 11/04; C25C 1/22

[52] U.S. Cl. ..... 204/105 R; 204/123; 204/250; 204/251

[58] Field of Search ..... 204/250-251, 204/96, 105 R, 123, 130

[56] References Cited

FOREIGN PATENT DOCUMENTS 797502 7/1958 United Kingdom ..... 204/105 R

*Primary Examiner*—R. L. Andrews

*Attorney, Agent, or Firm*—Karl F. Ross

[57] ABSTRACT

The invention relates to a new a method for simultaneous recovering vanadium, molybdenum and gallium from alumina factory aluminate liquors. The recovering is carried out in one step by electrolyzing an alumina factory aluminate liquor a temperature exceeding 70° C. with a current density of from 400 to 1200 A/m$^2$ using a low-melting liquid alloy as a cathode and agitating said alloy mechanically.

By using the new process the three precious metals can be recovered simultaneously in one step with good efficiencies without any preliminary treating of the aluminate liquor and without using any auxiliary chemical.

1 Claim, No Drawings

PROCESS FOR SIMULTANEOUS RECOVERY OF VANADIUM, MOLYBDENUM AND GALLIUM FROM ALUMINA FACTORY ALUMINATE LIQUORS

FIELD OF THE INVENTION

The invention relates to a new process for recovering molybdenum, gallium and vanadium from alumina factory aluminate liquors.

According to the invention the above-mentioned metals are recovered together, in one step by electrolyzing the alumina factory aluminate liquor at a temperature exceeding 70° C. with a current density of 400 to 1200 A/m$^2$, the electrolysis being performed using a low-melting liquid alloy as a cathode and agitating said alloy mechanically.

BACKGROUND OF THE INVENTION

Several methods are known for recovering gallium from aluminate liquors. Nowadays the "direct" recovery processes are generally used. Such "direct" processes are e.g. the mercury-pool cathode process (disclosed in Hungarian Pat. No. 145 729 and U.S. Pat. No. 2,793,179), electrolysis accomplished by using a liquid gallium cathode (disclosed in French Pat. No. 1 418 513) or by using a solid cathode (described in Hungarian Pat. No. 156 992 and U.S. Pat. No. 3,677,918), extraction with organic solvents (disclosed in Hungarian Pat. No. 164 521) and cementation by gallium (described in U.S. Pat. No. 3,988,150, USSR Pat. No. 263 154, 329 792 and 510 848).

The methods for recovering vanadium from alumina factory aluminate liquors are particularly based on crystallization. Such methods are disclosed e.g. in the following publications: Osvald, Z., Skuteczky, E., Zambo, J., Toth, B: Femipari Kutatointezet Közlemenyei [Proceeding of the Metallurgical Industry Research Institute, published in Hungary], V., 53-62, (1961): Tarasenko, V. Z., Zazubin, A. I., Ponomarev, V. D., Baespalov, E. N.: Trudi Inst. Met. i Obogashch. Akad. Nauk. Kaz. SSR, 27, 66-74, (1968), Juhasz, A: Kohaszati Lapok [Metallurgical Periodicals, published in Hungary], 4, 161-168, (1958). Chemical and electrochemical reduction methods are also used; such methods are disclosed e.g. in U.S. Pat. No. 3,677,918 and USSR Pat. No. 431 752, and in the following publications: Zazubin, A. I., Bocskarev, B. A., Romanov, G. A.: Trudi Inst. Met. i Obogashch. Akad. Nauk. Kaz. SSR., 27, 79-85, (1968), Slavina, E. L., Ivanova, G. A.: Ibid., 17, 20-26, (1966).

A method suitable for recovering molybdenum from alumina factory aluminate liquor is not yet known.

Each of the mentioned processes, although several of them are used in factories even now, has certain technical imperfections. For recovering gallium the industrial aluminate liquor must always be subjected to a preliminary purification and the recovering process is accomplished by using poisonous or expensive reagents (e.g. aluminum, organic extracting agents). For recovering vanadium the investment in the heating and cooling systems is high, and the need for special chemicals results in a high production cost. The primary disadvantage of each known recovery process lies in the fact that the sufficiency of these processes depends mainly on the technical circumstances of alum earth processing (e.g. presence of organic materials, other inorganic impurities, concentration rates), and for this reason such processes must be adapted to the particular aluminate liquor.

OBJECT OF THE INVENTION

The object of the present invention is to provide a new recovery process which can succesfully be applied without being dependent basically on the alum earth processing technology and without harmfully influencing it, while recovering the metals with a lower production cost, and eliminating the use of poisonous and/or expensive reagents.

DESCRIPTION OF THE INVENTION

The present invention provides an electrolytic process which allows the recovery of vanadium, molybdenum and gallium simultaneously. When the process according to the invention is applied, the aluminate liquor from which the metals are recovered need not be subjected to any preliminary treatment (e.g. cooling, removal of impurities). The process is performed in an electrolyzing cell made of a proper material, using a low-melting alloy as a cathode. The cathode composition can be e.g. 50% bismuth, 25% lead, 12.5% tin and 12.5% cadmium and an alkali-insoluble metal surrounded by an alkali-proof diaphragm can be used as an anode. The temperature of the electrolyzed aluminate liquor must be above 70° C. In order to reach a high recovery efficiency and to recover vanadium, molybdenum and gallium together the cathode current density is maintained between 400 and 1200 A/m$^2$ and the cathode is agitated mechanically. In the course of electrolysis vanadium and molybdenum form alkali-insoluble precipitates the form of lower-valent oxides, while gallium is alloyed into the cathode metal.

Summarizing the advantages of the process according to our invention they are as follows:

- three precious metals can be recovered in one step from alumina factory aluminate liquors;
- the aluminate liquors need not be subjected to any preliminary teatment; and
- the process requires only electrical energy and no other auxiliaries or chemicals are necessary.

The following examples illustrate the process according to the invention without delimiting its scope.

EXAMPLE 1

Industrial aluminate liquor containing 1 g/l of vanadium pentoxide, 0.2 g/l of molybdenum and 0.15 g/l of gallium were electrolyzed at a temperature of 90° C. for two hours with 800 A/m$^2$ current density, the cathode being agitated. The surface of the cathode was 20 cm$^2$, the volume of the electrolyzing cell was 150 ml. After finishing the electrolysis analysis of the solution save 0.04 g/l of vanadium pentoxide, 0.01 g/l of gallium and 0.08 g/l of molybdenum remained in the solution. On the basis of these data the recovery efficiencies are as follows:

| | |
|---|---|
| vanadium (in terms of the pentoxide) | 97% |
| molybdenum | 60% |
| gallium | 95% |

EXAMPLE 2

Industrial aluminate liquor containing 0.71 g/l of vanadium (as the pentoxide), 0.3 g/l of molybdenum and 0.18 g/l of gallium were electrolyzed at a temperature of 90° C. for two hours with 1000 A/m$^2$ current density, the cathode being agitated. After finishing the electrolysis 0.041 g/l of vanadium (as the pentoxide), 0.08 g/l of molybdenum and 0.1 g/l of gallium were found to remain in the solution. On the basis of these data the recovery efficiencies are as follows:

| | |
|---|---|
| vanadium (as the pentoxide) | 94% |
| molybdenum | 73% |
| gallium | 39% |

What we claim is:

1. An electrolytic process for recovering vanadium and molybdenum in the form of a precipitate of their alkali-insoluble lower valent oxides and for recovering gallium in the form of an alloy from an alumina factory aluminate liquor containing vanadium, molybdenum and gallium in solution, said electrolytic process comprising the steps of immersing in the alumina factory aluminate liquor which forms an electrolyte, a low-melting alloy cathode containing at least two elements selected from the group which consists of bismuth, lead, tin and cadmium, capable of alloying with gallium, and an anode comprising an alkali-insoluble metal surrounded by an alkali-proof diaphragm; and electrolyzing the alumina factory aluminate liquor forming the electrolyte at a temperature exceeding 70° C. with a current density of 400 to 1200 A/m$^2$ while mechanically agitating the cathode to form the precipitate and to alloy the gallium into the cathode.

* * * * *